US010240866B2

(12) United States Patent
Palic

(10) Patent No.: US 10,240,866 B2
(45) Date of Patent: Mar. 26, 2019

(54) VACUUM ROTARY AUTOMATIC DRYER FOR FRUITS, VEGETABLES, GRAINS, HERBS, MEDICINES AND GRANULATE

(71) Applicant: Marko Palic, Trstenik (RS)

(72) Inventor: Marko Palic, Trstenik (RS)

(73) Assignee: Marko Palic, Trstenik (RS)

( * ) Notice: Subject to any disclaimer, the term of this patent is extended or adjusted under 35 U.S.C. 154(b) by 0 days.

(21) Appl. No.: 15/108,666

(22) PCT Filed: Nov. 2, 2015

(86) PCT No.: PCT/RS2015/000023
§ 371 (c)(1),
(2) Date: Jun. 28, 2016

(87) PCT Pub. No.: WO2016/137349
PCT Pub. Date: Sep. 1, 2016

(65) Prior Publication Data

US 2018/0195797 A1 Jul. 12, 2018

(30) Foreign Application Priority Data

Feb. 23, 2015 (RS) ..... P-2015/0111

(51) Int. Cl.
*F26B 5/00* (2006.01)
*F26B 5/04* (2006.01)

(52) U.S. Cl.
CPC ..... *F26B 5/042* (2013.01); *F26B 5/04* (2013.01); *F26B 5/044* (2013.01)

(58) Field of Classification Search
CPC .. F26B 5/042; F26B 5/044; F26B 5/00; F26B 7/00; F26B 21/00; F26B 21/06
(Continued)

(56) References Cited

U.S. PATENT DOCUMENTS 2,316,459 A * 4/1943 Schmidt ..... F26B 11/0413 34/136
3,648,382 A * 3/1972 Oldenkamp ..... A23F 5/32 34/92

(Continued)

FOREIGN PATENT DOCUMENTS

CA 2816574 A1 * 5/2012 ..... F26B 17/103
EP 2635862 B1 * 5/2016 ..... F26B 17/103

(Continued)

*Primary Examiner* — Stephen M Gravini
(74) *Attorney, Agent, or Firm* — Schaffer, Schaub & Marriott, Ltd.

(57) ABSTRACT

Vacuum rotary automatic dryers for fruits, vegetables, grains, herbs, medicines and granulate, is composed of the box frame (5), the loading conveyor (6) and the hopper (7), whereby on the box frame (5) in the upper horizontal sector is the shaft (18), mounted to which the frame (8) is attached, in which a cylinder (4) is mounted with the cover (32), which rotates around its axis using an electric motor (11). In the cylinder (4) are small cylinders (1) inserted in which the products for drying are loaded. In the process of loading the products, cylinder (4) with the cylinders (1) is placed in a vertical position, and then, in the drying process, it is rotated into a horizontal position by a pneumatic cylinder (19). Low-pressure in smaller cylinders (1) is achieved using a vacuum pump (2), and the warm water is fed through a swivel joint (25) through a hollow shaft (9) in the central tube (26) and the space of cylinder (4) and flows around the outer surface of small cylinders (1). The area under the cover (32) and in small cylinders (1) is connected with the circulating pump (21) which pushes water while washing the products through a vacuum distributer (20) filling about ⅓ of useful volume. Through the PLC controller (22) cycles of washing and drying of the product, as well as washing of small cylinders (1), take place automatically. In accordance with the idea of the invention, the vacuum is achieved only in small cylinders (1), which reduces the dimensions and quantity of materials for the construction of dryers, as well as the energy consumption, because the design allows the evaporation with low-pressure below 50 millibars and a (Continued)

heating temperature below 40° C. The product quality is also improved because of the slight movement of the products prevents them from sticking to the inner walls of the smaller cylinders (1) and the walls of the augers (3,41) and thus prevents damage to the membrane, which is especially important when drying fruits. The invention also allows, that in the same device, washing of products before drying and washing of small cylinders (1) and augers (3, 41) after unloading of dried products, which is very important, because hand washing with existing dryers significantly increases the time between two drying cycles. The invention also allows that the space for the products, i.e. in smaller cylinders (1), is fed with chemical solutions in liquid or gaseous state using a circulating pump (21), e.g. in order to protect grains from fungal diseases (aflatoxin, etc.), as well as solutions which enhance the appearance of the dried product.

9 Claims, 2 Drawing Sheets

(58) Field of Classification Search
USPC ..... 34/92
See application file for complete search history.

(56) References Cited

U.S. PATENT DOCUMENTS 4,127,947 A * 12/1978 Webb ..... A23B 7/02 34/403
5,557,858 A * 9/1996 Macaluso ..... F26B 3/283 34/203
5,651,193 A * 7/1997 Rhodes ..... F26B 17/122 34/531
5,659,974 A * 8/1997 Graeff ..... B01D 53/06 34/378
5,893,218 A * 4/1999 Hunter ..... F26B 9/063 34/168
5,909,943 A * 6/1999 Poirier ..... F26B 25/002 34/172
6,105,273 A * 8/2000 Johanson ..... B01J 8/08 34/267
6,230,421 B1 * 5/2001 Reed, Sr. ..... F26B 17/26 34/167
7,380,348 B2 * 6/2008 Seebach ..... B04C 3/00 34/326
8,365,433 B2 * 2/2013 Ogura ..... C05F 9/02 34/339
8,726,532 B2 * 5/2014 Hogan ..... F26B 17/103 15/345
9,221,027 B2 * 12/2015 Kuppler ..... B01J 10/005
9,291,391 B2 * 3/2016 Hogan ..... F26B 17/103
9,309,477 B2 * 4/2016 Foss-Smith ..... F23K 1/00
9,897,376 B2 * 2/2018 Nakata ..... F26B 17/32
2012/0043194 A1 * 2/2012 Lepez ..... C10B 7/10 201/10
2015/0068806 A1 * 3/2015 Duran Toro ..... E21B 49/00 175/50

FOREIGN PATENT DOCUMENTS

WO WO 2006066096 A3 * 12/2006 ..... F26B 17/04
WO WO 2012061367 A1 * 5/2012 ..... F26B 17/103

* cited by examiner

VACUUM ROTARY AUTOMATIC DRYER FOR FRUITS, VEGETABLES, GRAINS, HERBS, MEDICINES AND GRANULATE

CROSS REFERENCE TO RELATED APPLICATION

This application claims the benefit of PCT Application No.: PCT/RS2015/000023 with the international filing date of 2 Nov. 2015.

TECHNICAL FIELD TO WHICH THE INVENTION RELATES

The invention belongs to the field of drying fruits, vegetables, grains, herbs, medicines, granulate and the technology of moisture evaporation under reduced pressure, e.g. in vacuum. According to the International Patent Classification the patent code is: F 26B 5/04

TECHNICAL PROBLEM

How to design a dryer for drying fruits, vegetable, grains, herbs, medicines and granulate, so that the drying process is performed under reduced pressure, which is below the atmospheric pressure, i.e. low-pressure, to improve the drying process in lower vacuum and lower temperatures, as well as to save energy, so the transfer of heat is uniform and through direct contact with the heating surfaces, whose position is changing constantly with gentle rotation of the dryer and with the same device washing of the products before drying as well as washing of the device after drying can be performed.

STATE OF THE ART

From available literature and promotional materials from national and international manufacturers, as well as patent based research, the drying process is carried out in a low-pressure chamber, but the product is placed on a fixed wattle, or in a mix chamber, whereby only a small part of the same surface of the drying products is exposed to the heating surface. The disadvantage of this process is the high energy consumption as well as the product sticks to the wattle during the drying process because of the movement deficit, or the product gets damaged by the mixer and therefore the membrane or outer part of the product is also damaged. The whole space of the drying chamber is exposed to vacuum, which limits the capacity, because the increasing dimensions require great reinforcements in structure to withstand the forces caused by vacuum. The existing solutions require pre-washing of the products in separate devices. Charging and discharging of such dryers is done by hand, as well as their cleaning and washing after drying. This causes great time consumption for preparing dryers for a new drying cycle.

ESSENCE OF THE INVENTION

The essence of the invention is the evaporation of the fluid from the product, which is performed under low-pressure and is achieved through direct contact of the product with the heating surfaces, because the products are put into the vacuum area, which consists of multiple smaller cylinders in which augers are enclosed within the small cylinders and these small cylinders are fitted into one big cylinder which is rotating slowly around its axis. This produces a slight movement of the products achieving that all parts of the products are in contact with the internal volume of the smaller cylinders and augers, which are heated with warm water that circulates through the larger cylinder and the void in the augers. This contributes to saving energy while drying because the pressure can be dropped below 50 millibars and the drying temperature below 40° C. but the heat transfer and the product does not decrease significantly (vacuum is essentially an insulator for heat transfer and therefore the existing vacuum dryers consume more energy, and for the same capacity and they are considerably larger than the dryer which is the subject of this invention). With the small and continuous movements of the products capillary phenomena in the products are promoted, which further accelerates the evaporation of fluid from the products, and the products do not stick to the heating surface, so the membrane of the product is not damaged and a superior quality of dried product is achieved. The invention also enables washing of products before drying, and also washing of the smaller cylinders and the augers after unloading of dried products in the same device, because the augers which are in the smaller cylinders facilitate cleaning of the smaller cylinders (the washing process with the existing dryers is done by hand and takes a long time, which reduces the productivity of the dryer). The invention also enables that the space for the products, i.e. smaller cylinders (1), is fed with chemical solutions, for example, to protect the cereal from fungal disease, or improving the appearance of the product after drying. Using Programmable Logic Controllers (PLC) controllers, these processes take place fully automatically.

A BRIEF DESCRIPTION OF THE DRAWINGS

The invention is shown in the following illustration draft:

DETAILED DESCRIPTION OF THE INVENTION

Figure 1:
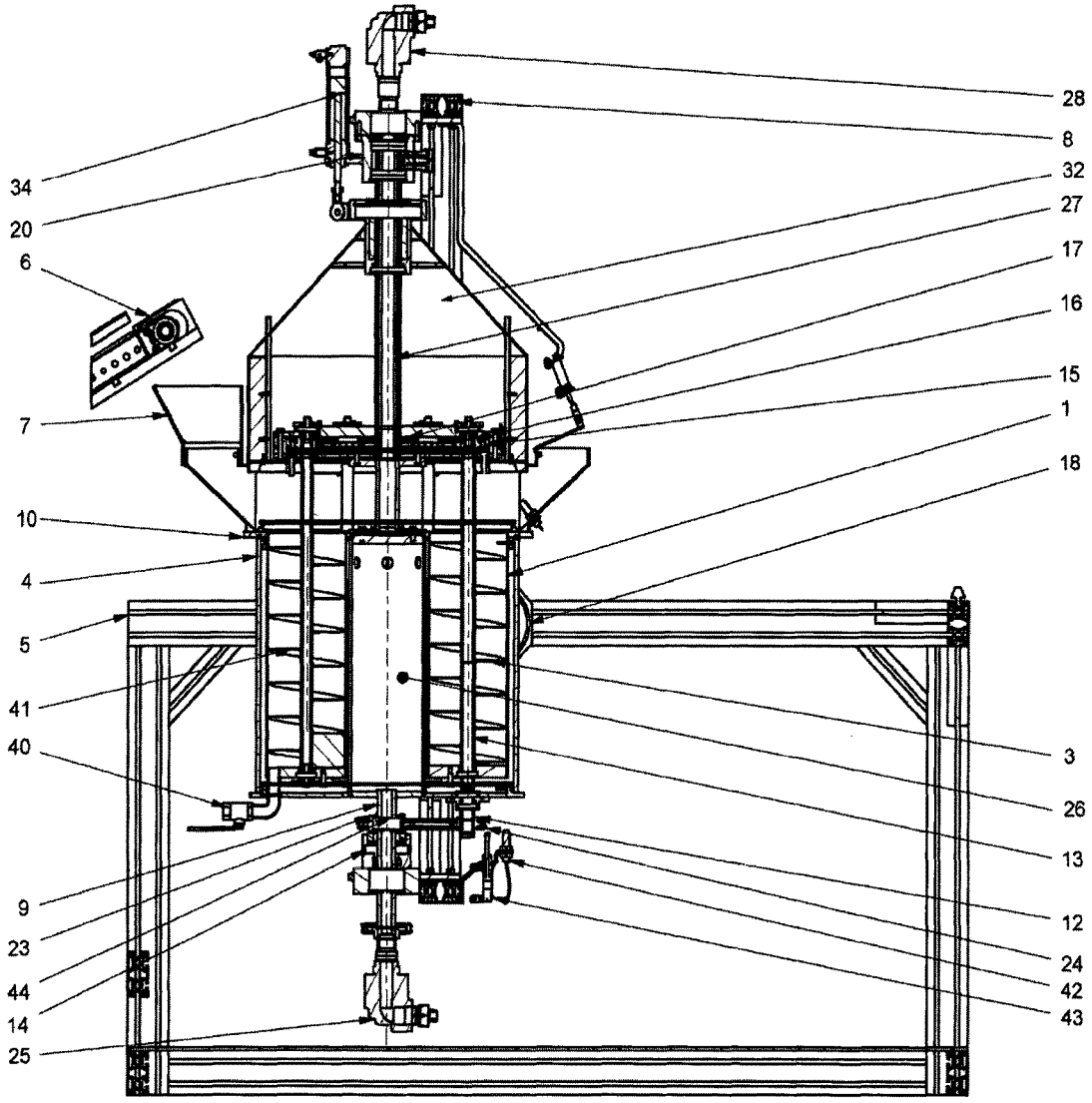
FIG. 1, shows the device in a vertical position in the cross section view (in this position the dryer is loaded with products)
Figure 2:
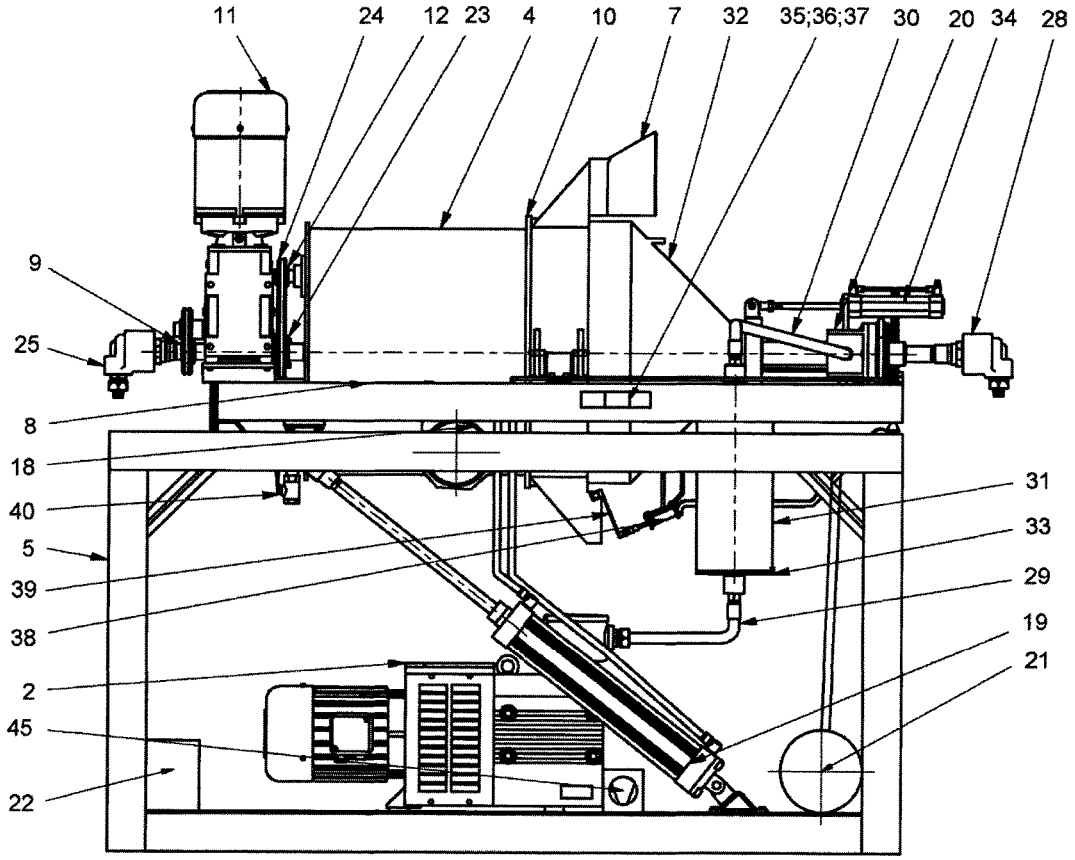
FIG. 2, shows the device in a horizontal position (in this position washing of products prior to drying is carried out, also the drying of the products and washing of the small cylinders and augers after the finished process of drying is carried out)

The present invention is a vacuum rotary automatic dryer, for fruits, vegetable, grains, herbs, medicines and granulate, consists of a box frame 5 in which in the top section an axle 18 is horizontally supported to which a frame 8 is mounted. In the frame 8 a cylinder 4 is supported which rotates around its axis using an electric motor 11, and using a pneumatic cylinder 19 which is attached to the box frame 5 and the frame 8 can be rotated in a vertical and horizontal position. In the cylinder 4, there are inserted and mounted smaller cylinders 1 in which the augers 3, 41 are mounted, which rotate because of the chain 15 and the sprocket 16 mounted in the casing 17. The drive of the sprocket 16 is achieved using the rotating movement of cylinder 4, on whose shaft 9 the central sprocket 23 is located, which is mounted with the bearing 44 on the shaft 9, which can rotate freely, whereby the central sprocket 23 stays still when the electromagnetic clutch 14 engages it through which the shaft 9 passes which is forced to rotate together with the operating part of shaft 9, which transfers rotation using the chain 24 and the sprocket 12 to the auger 3 and further to the auger 41. Heating the dryer is done with warm water, which is fed from an external source (e.g. heat pump, solar collectors, biomass boiler, gas boiler or electric power) using the swivel joint 25 through the shaft 9, which is hollow in the space of the central tube 26. Warm water from the central tube 26 flows around the external surfaces of the small cylinders 1 and coming into the space of cylinder 4 in front of the entrance of axle 13, auger 3 and the entrance of the auger 41 through which the water passes up to the hollow shaft 27 and through the swivel joint 28 back to the external source of warm water. Vacuum is achieved using a vacuum pump 2 which is mounted to the frame 5 and connected with tubes 29, 30 through the condenser 31 and vacuum distributor 20 with the space under cover 32 which aligns with the top sheer 10 of cylinder 4 and closes the small cylinders 1. Therefore, vacuum acts only in the space under cover 32, i.e. in the small cylinders 1. When it comes to evaporation, the vacuum pump 2 constantly draws vapor from the space of cylinder 1 through the condenser 31 where vapor is condensed. On this occasion transferred heat, achieved with condensed vapor using the heat pump 45, returns to the source of the heat achieving additional savings and energy effectiveness from this process. Releasing condensate, or rather distilled water, is done with a tap 33 and this water is used as a by-product. Products are loaded with the loading conveyor 6 and hopper 7 in the space between the entrance of the small cylinders 1 and the casing 17, and product loading is stopped when the space is full. The cylinder 4, in that occasion is in a vertical position and rotates slowly during loading. The cover 32 is placed in an open position using a pneumatic cylinder 34 and a pneumatic valve 35. In that moment the electromagnetic clutch 14 is turned on and the rotation of auger 3 and auger 41 starts, loading the space of the small cylinders 1 with products to dry. After loading of the small cylinders 1 by turning on the pneumatic control valve 36 and the pneumatic cylinder 19, the cylinder 4 is placed in a horizontal position. By turning on the pneumatic control valve 37 and the pneumatic cylinder 38, the cover 39 is opened and the surplus of product which did not stay in the space of small cylinders 1 is removed. By turning on the pneumatic control valve 35, using the pneumatic cylinder 34 the small cylinders 1 are closed with cover 32. By turning on the circulation pump 21 water for washing the product is fed through the vacuum distributor 20 into the space of small cylinders 1 to ⅓ of their volume. Water is heated for more effective washing. The entire time cylinder 4 is rotating constantly with a possibility of change of direction of the rotation as desired. During washing and later during drying, the rotation of the operating auger 3 and also the auger 41 are stopped. After washing of products, with the micro-switch 42 the cylinder 4 is positioned so that the tap 40 has the lowest position and by using the pneumatic cylinder 43 it acts on the tap 40 and water is let out into a drain.

In accordance with the preferred embodiment of the invention, vacuum is realized only in the small cylinders 1, in that part of the space which is not filled with products, which significantly reduces the dimensions and the quantity of materials used for construction of the dryer, as well as the amount of used energy because the volume of the vacuum is minimal, and considering the rotation of cylinder 4 the products simultaneously perform slight movements in the small cylinders 1 due to which all the surfaces of the products are in contact with the walls of the small cylinders 1 and the augers 3, 41, which stimulates the capillary phenomena in products, so that the evaporation of fluid from products is additionally accelerated which additionally reduces energy consumption. The invention also allows that in the same device, washing of products before drying, as well as washing of small cylinders 1, operating auger 3 and auger 41 after unloading of dried products, can be performed, which shortens the cycle of washing between two processes of drying. The invention also allows that in the space for products i.e. smaller cylinders 1, chemical solutions in liquid or gaseous state can be fed, i.e. in order to protect grain from fungal infection or improving the appearance of the product after drying, and using a PLC controller 22, these processes are fully automatic.

TYPE OF INDUSTRIAL OR OTHER APPLICATIONS OF THE INVENTION

The subject of the invention, vacuum rotary automatic dryer for fruits, vegetables, grains, herbs, medicines and granulate, is technologically feasible for manufacturing, because the equipment for its production does not need new technologies and special machines.

The invention claimed is:

1. Dryer for items such as fruits, vegetables, grains, herbs, medicines, and granulate comprising:

a box frame having a top section;

an axle horizontally supported on the top section of the box frame;

a cylinder is rotatably mounted on the axle, the cylinder disposed for being rotatably position in a vertical or horizontal position on the axle;

at least one smaller cylinder disposed in the cylinder, the at least one smaller cylinder designed to receive items to be dried;

an auger rotatably disposed in each of the at least one smaller cylinders, the auger being designed to move the items to be dried in the at least one smaller cylinder when the auger is rotated;

a drive mechanism to connected to the auger for causing the auger to rotate;

a vacuum pump operatively connected to the at least one smaller cylinder, the vacuum pump functioning to reduce the pressure in the at least one smaller cylinder; and a central tube positioned in the cylinder adjacent to the at least one smaller cylinder, the central tube disposed for receiving warm water whereby the warm water flows around an external surface of the at least one smaller cylinder to dry the items.

2. The dryer of claim 1 wherein a pneumatic cylinder rotates the cylinder around the axle.

3. The dryer of claim 1 wherein a vacuum distributor connects the at least one smaller cylinder to the vacuum pump.

4. The dryer of claim 1 wherein a hollow shaft is operating connected to the central tube, the hollow shaft connected to a source of warm water, whereby warm water flows around an external surface of the at least one cylinder.

5. The dryer of claim 4 wherein a cover is positioned over the at least one small cylinder, the cover defining a space over the at least one small cylinder, the space being connected with a circulating pump to supply water for washing the items to be dried.

6. The dryer of claim 5 wherein the circulating pump is connected to the space through the vacuum distributor.

7. The dryer of claim 6 wherein the cycle of washing and drying of items is controlled by a PLC controller wherein the modes of washing and drying of products, temperature of water, as well as the of vacuum intensity in the at least one cylinder is adjusted.

8. The dryer of claim 7 wherein a hopper is positioned on the cover for receiving the ferns.

9. The dryer of claim 8 wherein a loading conveyor is positioned adjacent the hopper for supplying items to the dryer.

* * * * *